US006899253B2

(12) United States Patent
Uemura et al.

(10) Patent No.: US 6,899,253 B2
(45) Date of Patent: May 31, 2005

(54) CAP FOR MOUNTING ON AN AEROSOL CONTAINER

(75) Inventors: Hideo Uemura, Osaka (JP); Riichi Ogawa, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/787,230

(22) Filed: Feb. 27, 2004

(65) Prior Publication Data

US 2004/0164103 A1 Aug. 26, 2004

Related U.S. Application Data

(62) Division of application No. 10/384,654, filed on Mar. 11, 2003, which is a continuation of application No. 09/899,913, filed on Jul. 9, 2001, now Pat. No. 6,564,977.

(30) Foreign Application Priority Data

| | | |
|---|---|---|
| Dec. 28, 1998 | (JP) | 10-376996 |
| Sep. 30, 1999 | (JP) | 11-280547 |
| May 31, 2001 | (JP) | 2001-165002 |
| Jun. 29, 2001 | (JP) | 2001-199496 |

(51) Int. Cl.[7] ..... B65D 83/24
(52) U.S. Cl. ..... 222/182; 222/402.13; 222/402.14
(58) Field of Search ..... 222/182, 402.13, 222/402.14

(56) References Cited

U.S. PATENT DOCUMENTS

| | | | |
|---|---|---|---|
| 3,137,414 | A | 6/1964 | Steinkamp |
| 3,178,077 | A | 4/1965 | Benedetto |
| 3,744,682 | A | 7/1973 | Blank |
| 4,197,915 | A | 4/1980 | Martin |
| 4,416,399 | A | 11/1983 | Parr et al. |
| 4,428,509 | A | 1/1984 | Emerson et al. |
| 5,791,524 | A | 8/1998 | Demarest |
| 6,564,977 | B2 | 5/2003 | Uemura et al. |

FOREIGN PATENT DOCUMENTS

| | | |
|---|---|---|
| JP | A 3-56237 | 3/1991 |
| JP | A 10-53289 | 2/1998 |
| JP | A 11-70986 | 3/1999 |
| JP | 2000191062 A | 7/2000 |
| JP | A 2001-19067 | 1/2001 |

*Primary Examiner*—Kenneth Bomberg
(74) *Attorney, Agent, or Firm*—Oliff & Berridge, PLC

(57) ABSTRACT

A cap for mounting on an aerosol container, which is able to automatically release the gas remaining therein with a simple action, when the container is to be discarded, said cap comprising a top plate member having a periphery connected to an upper end portion of a tubular body, wherein said top plate member has an aperture and a lid for closing the aperture, said lid has a fixed end which is connected to a margin of the aperture through a bendable line, such that the lid is able to turn from a first position in which the lid closes the aperture, to a second position in which the lid is protruding into the tubular body member so as to get in touch with a top face of the discharge head that is depressed downwardly, and the top plate member also has a stopper for fixing the lid in the second position so as to keep the discharge head in such a pressed state.

2 Claims, 15 Drawing Sheets

PRIOR ART

PRIOR ART

CAP FOR MOUNTING ON AN AEROSOL CONTAINER

This is a Division of application Ser. No. 10/384,654 filed Mar. 11, 2003 which is a Continuation of application Ser. No. 09/899,913 filed Jul. 9, 2001 now 6,564,977. The entire disclosure of the prior applications is hereby incorporated by reference herein in its entirety.

TECHNICAL FIELDS

The present invention relates to a cap or cover for mounting on a head portion of an aerosol container, particularly a cap for facilitating safe and easy release of a pressurized gas contained in such an aerosol container for discharging the same.

BACKGROUND

In a prior art, an aerosol container is widely used for discharging various kind of agent such as a paint, a cleaner, a hair-conditioner, an aromatic, and an insecticide. In such a container, not only an effective ingredient of the paint etc., but also a pressurized gas or an evaporable solvent for discharging the ingredient as a mist to the out of the container. These pressurized gas and the evaporated solvent may still remain in the container after the container is discarded, being used out or rendering unnecessary. The container with its content remaining therein should not be burned to discard, since it may be exploded. Moreover, the above-mentioned ingredient may be harmful to human body. Accordingly, it is desirable that the contents such as the gas are released before the container is discarded.

When the used out or unnecessary container is discarded, several methods are taken for releasing the gas or effective ingredient in the prior art. One of the method is to bore a hole on a body of the container by using a nail, drill, etc., by hand. The other one is to use a special boring device for making a perforation from which the gas or the ingredient is discharged. However, the former method may cause a problem in view of safety or sanitation, since the discharged content such as the gas may fall on a person who execute the boring operation. It may also causes an another problem that contents such paint may be discharged together with the gas and soil the person or the place therearound. On the other hand, the latter method is not suitable for a personal or a home use, since it needs a place or cost for installing the device.

In order to solve the above mentioned problem, the Japanese Patent Laid Open No. 10 (1998)-53289 provides an aerosol container by which anybody can release the gas or the content remaining in the container with ease. As shown in FIG. 24, the container includes a cap 101 having a turbular body and a top plate connected thereto, and a container body 103 having a discharge head upwardly protruding through a stem, and a winding rim on which the cap is fitted. The top plate has a center portion which is depressed to step into the inside of the cap to form a recess 105 into which a caulking portion of a mounting cap is able to be fitted. At the center of the recess, a small-diameter, cylindrical protrusion 106 is formed for engaging with a nozzle portion 102 of the aerosol container, with a gas-discharging hole 206 being formed in a vicinity of a bottom of the cylindrical portion.

For releasing the gas in the container body of the aerosol container with such a cap, the cap is removed from a head of the container body, and recapped again in an inverted posture. As shown in FIG. 25, when an engagement portion formed around the recess is fitted and secured to the above-mentioned caulking portion, the discharge head is engaged into the cylindrical protrusion of the cap and depressed downwards, keeping a discharging state unless the cap is separated from the container body.

However, the above-mentioned container is troublesome, since the cap has to be removed from the container body and inverted to recap again. And also, at the time of releasing the cap mounted on the head portion of the container body is upwardly open, such that when the content such as paint is discharged accompanying with the gas, the content scatters upwardly, soiling the person and place therearound.

Moreover, the top plate of the cap has a complicated, concave and convex structure for keeping the release of the content with a user's hand free from the container. When such a cap is integrally made of synthetic resin, a mould for forming the cap has to have a complicated structure, increasing a cost for manufacture.

To solve such a problem, Japanese utility model Registration No. 3056237 discloses another aerosol container with a cap 221 enabling the release of the content, shown in FIG. 26. The cap, which is integrally made of synthetic resin, and comprises a tubular body having at its end means for engaging with a winding portion of a container body, and an inclined top wall which is connected to the tubular body and has a depression piece 110 connected by a hinge for depressing a depression head 111.

For discarding this container when it is used out or unnecessary, the user should hold the container body with one hand while with the cap putting on the container body, and press the depression piece 224 of the top plate of the cap by the other hand, such that a connection link for supporting the depression piece is broken, and the depression piece falls into the cap by turning on the hinge 225 so as to press a discharge head 226, from which the contents remaining in the container body such as the pressurized gas and the paint or the other component are discharged.

Due to the construction of this container, a substance ejected energetically from the discharge head strikes against the inside of the cap, and is confined initially within the cap, and then generally escaping from it to the outside through an aperture formed by tearing around the periphery of the depression piece. This structure contributes to prevent the contents from ejecting outside directly so as to scatter around and soil the person and place therearound. Particularly, the content is not blown strongly to the nearby person. However, according to the above-mentioned structure, after the depression piece is pressed into a discharging position by the finger and then it is released, the depression piece is not able to halt at the discharging position by itself, and returns to its original position by a pushing up force of the discharge head. Accordingly, it is not possible to discharge all of the remaining content automatically.

Japanese Patent Laid Open No. 2001-19067 discloses an aerosol container enabling the automatic release of the remaining content, which has a container body from a top of which an upwardly biased discharge head is protruding, and a cap having a turbular body with a lower end engaged to the upper end of the turbular body, and a top plate covering an upper surface of the turbular body. The top plate has a downwardly tapering peripheral portion and an upwardly convex center portion which may be elastically inverted into a concave or downwardly protruding posture so as to forcibly depress the discharge head by the inversion of the center portion. However, in this container, the center portion is possibly pushed into the inverted, concave posture by a contact of some object or miss-operation of the user, such that the content of the container is release in the period of use against the will of the user. Moreover, in a normal mode for gas-releasing, when the container is treated roughly, for example throwing into a garbage box before the gas exhaustion is completed, the inverted center portion of the top plate may return to an original shape due to the strike against other obstacle, such that the gas-releasing halts insufficiently.

Japanese Patent Laid Open No. 11(1999)-70986 discloses another aerosol container enabling the automatic release of the remaining content, which has a tilt-type container body from which a discharge stem is erecting, from which the content is discharged only when the discharge stem is tilt or inclined from a vertical posture, a discharge tube fitted on the discharge stem and having an outward flange on a lower end of the tube itself, and a cap having a top-closed peripheral wall for connecting with a top end of the container body, whereby the peripheral wall is provided at its one side with a pair of upper and lower split lines, between which a reversible engagement plate is formed for elastically turning over into the inside of the cap, and engaging with a depressed side of the outward flange when the discharge stem is tilt, to keep the tilt posture to keep on discharging. However, the structure of the cap is effective only for the tilt type container.

SUMMARY OF THE INVENTION

The primary object of the present invention is to provide a cap for mounting on an aerosol container, which enables an automatic release with a simple action, by turning a lid defined by a part of its top wall into a second position in which the lid orient into the cap so as to depress the discharge head of the container and providing a stopper for fixing the lid.

For achieving this purpose, the present invention provides;

a cap for mounting on an aerosol container having a container body ( ) with a top end from which a discharge head 3 is protruding upwardly, said cap comprising;

a turbular body member having a lower part which is able to be engaged to an upper part of said container body, a top plate member having a periphery connected to an upper end portion of the turbular body member so as to close a top surface of the turbular body member, wherein said top plate member has an aperture and a lid for closing the aperture, said lid has a fixed end which is connected to a margin of the aperture through a bendable line, such that the lid is able to turn from a first position in which the lid closes the aperture, to a second position in which the lid is protruding into the turbular body member so as to get in touch with a top face of the discharge head that is depressed downwardly, and the top plate member also has a stopper for fixing the lid in the second position so as to keep the discharge head in such a pressed state.

The second purpose of the present invention is to prevent such a cap with the lid having one or more folding plates, for mounting on the aerosol container, which is adapted to lock the discharge head in a depressed state not only pushing the folding plate(s) into the cap but also engaging each folding plate directly or indirectly with the stopper for fixing the folding plate immovably, such that an intentional release of the contents due to miss-operation of the user, etc., is favorably prevented.

For achieving this purpose, three type of caps are proposed, each of which comprise the structure described in the first purposed of the present invention and are characterized by the following additional features.

One of the cap has the aperture which is defined by a pair of vent holes, and the lid which is defined by a pair of folding plates for covering the vent holes and depressing the discharge nozzle, a pair of fitting portions are formed at opposed faces of the folding plates in the second position for providing mutual engagement, such that either of the folding plates function as the stopper for fixing the other of the folding plates.

Another cap has the lid which is defined by a folding plate having the fixed end jointed to the margin of the aperture through the bendable line, and the stopper is protruding downwardly from a reminder of the margin except the bendable line for engaging with the folding plate in the second position.

The other cap has the aperture deviating from a longitudinal central axis of the discharge nozzle and having an inner marginal portion which is close to the central axis; the lid formed by a folding plate being connected to the inner marginal portion for covering the aperture and a depression plate protruding from an underside of the folding plate in the first position; and the stopper is depending from one side of the top plate portion opposite to the bendable line for engaging with a leading end portion of the depression plate.

The third purpose of the present invention is provide such a cap with the aforementioned lid which may turn on the fixed end into the cap, moving away from an opening of the aperture to the second position in which the lid is locked with the stopper. To achieve this purpose, the lid may preferably turn 90 degrees or more with respect to the top plate member when it shifts from the first position to the second position.

The fourth purpose of the present invention is to depress the discharge head certainly to a prescribed discharging position in the type of the cap having the pair of folding plates, by that the first and second fitting portions are allowed to fitted each other only when the pair of folding plates are parallel and vertical to the vertical to the top plate member.

The fifth purpose of the present invention is to carry out the automatic release with more ease, preferably by a single action. This purpose is achieved by that the said pair of vent holes function as finger receiving hole, through which the folding plates are pressed to turn into the second position without removing the cap from the container.

The sixth purpose of the present invention is to guarantee a comfortable use of the cap according to the present invention, particularly having the pair of folding plates, by removing a possible inconvenience in the use of the same. In a case the gas releasing operation is carried out with the cap putting on the container, it is preferable to make a chamfer at a corner between the circumferential surface and upper surface of the discharge head in order to reduce the resistance when the free end of the folding plate rides over the corner of the discharge head. Moreover, in a case the gas releasing operation is carried out by removing the cap from the container to fit the first and second fitting portions, and recapping it again, it is preferable that the partition plate has a thickness and width sufficient for resisting a shearing stress so as to depress the discharge head by means of the folding plates in the second position, when an user, griping the cylinder body member, removes the cap from the aerosol container to fit the first and second fitting portions, and fit the cap on the aerosol container.

Further purpose will be apparent from the following description of the present invention.

BRIEF EXPLANATION ON DRAWINGS

BEST MODE FOR CARRYING OUT THE INVENTION

Figure 1:
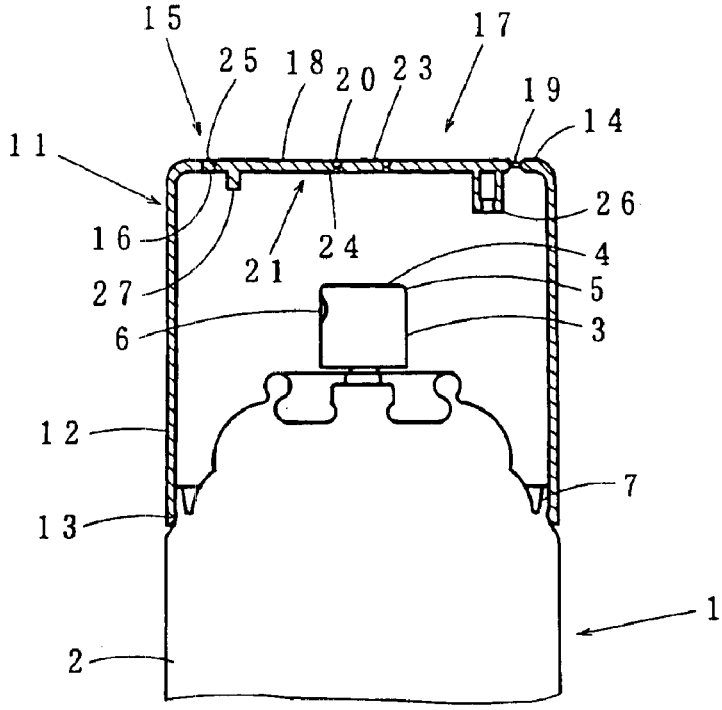
FIG. 1 is a vertical sectional view of a cap according to a first embodiment of the present invention, which is mounted on an aerosol cap.

FIG. 1 to FIG. 7 shows a cap for an aerosol container according to the first embodiment of the present invention.

For convenience' sake, the aerosol container to be used with the cap is explained herewith.

Numeral 1 designates an aerosol container having a container body 2 with a top wall from which a discharge head 3 is protruding through a stem which is upwardly biased. The discharge head according to this embodiment is a depression head from which the liquid is discharged by depressing it vertically. The discharge head 3 preferably has a generally flat upper surface 4 for getting in contact with later-described folding plates, while the upper surface meets with a circumferential surface of the discharge head 3 at a corner 5 therebetween. A nozzle 6 is provided at the surface of the discharge head 3. A longitudinal, central axis (C) of the discharge head 3 coincides with a central axis of the container body 2. The top wall of the container body has at its periphery a winding end 7 to which an outer circumferential wall is connected.

Numeral 11 designates a cap (or a cap body) for mounting on the aerosol container. The cap has a turbular body member 12, which is provided at its lower end with an engagement device 13 such as an engagement rib for engaging with the winding end 7, and a top plate member 14 having a periphery connected preferably to the turbular body member 12, as shown in FIG. 1. The bonding strength of the engagement device 13 should be sufficient for keeping the engagement against the biasing force of the discharge head 3, when the discharge head is depressed by the cap as described later.

Figure 2:
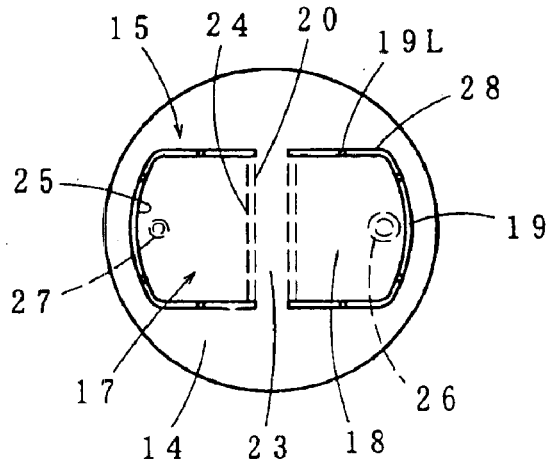
FIG. 2 is a top plan view of the cap shown in FIG. 1.
Figure 3:
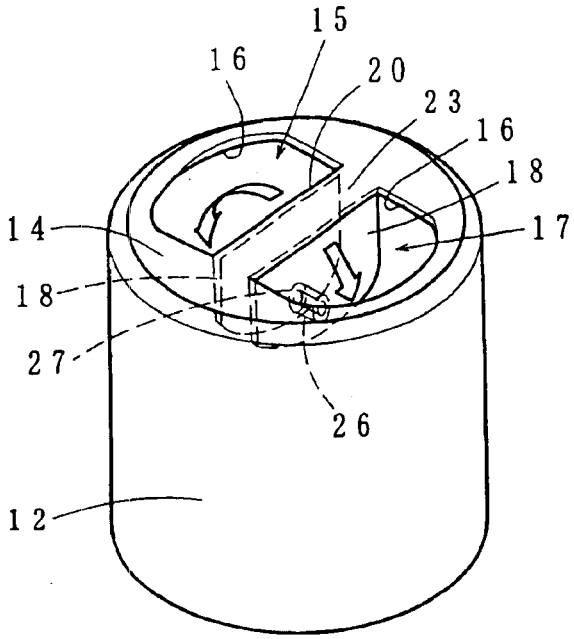
FIG. 3 is a perspective view of the cap shown in FIG. 1.

The top plate member 14 has an aperture 15 having enough size for ventilation or gas releasing, and a lid 17 for closing the aperture and depressing the discharge head 3. In a preferred shown embodiment, the aperture 15 is divided into a pair of symmetrical vent holes 16, 16 of the same size and same shape, and the lid 17 is formed of a pair of folding plates 18, 18 for covering said vent holes respectively as shown in FIG. 2, however, the aperture 15 may be a singe vent hole and the lid may be formed into a single plate, as will be embodied in later-described second and third embodiment.

The aperture 15 is located generally above the discharge head 3, i.e., in a center portion of the top plate member 14 usually.

The lid 17 is preferably formed by a part of the top plate member 14, that is enclosed, for example, by a generally C-shaped break line 19 and a generally straight bendable line 20 (which is made by a hinge preferably) connecting between the two ends of the breaking line, such that the lid 17 may turn on the bendable line 20 from a first position in which the lid closes the aperture 15 to a second position in which the lid is protruding into the turbular body member 12 so as to get in touch with the discharge head 3, after the break line 19 is broken. The lid 17 is fixed immovably to contact with the upper face of the discharge head 3 in the second position by means of a stopper 21 for maintaining such a depressed state. In the present embodiment, as described later, the either of the folding plates functions the stopper for fixing the other of the folding plates, however, the stopper 21 may have any other structure for fixing the lid, including an equivalence of that of succeeding second and third embodiments. Meanwhile, the break line 19 may preferably be made by a split and one or a plurality of fragile links 19*a*.

Figure 4:
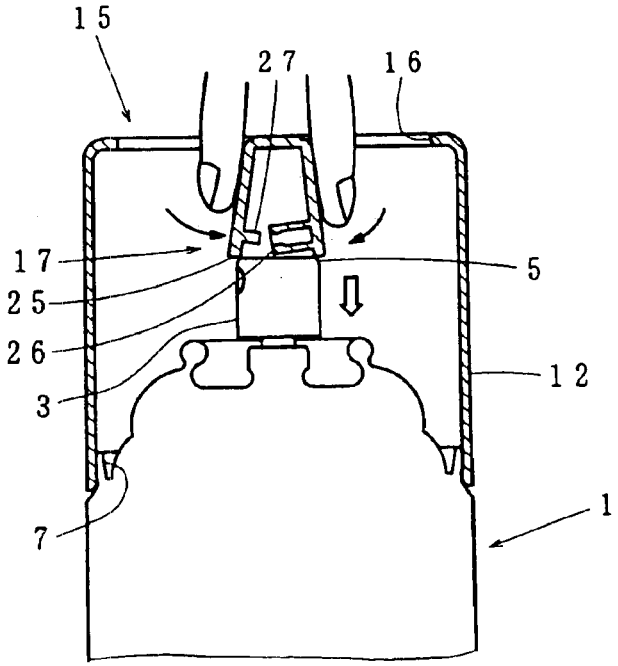
FIG. 4 is an explanation view on the gas-releasing operation showing an intermediate state thereof.

In the preferred shown embodiment, the aperture 15 is divided by a partition plate 23 into the pair of vent holes 16, 16. It is favorable that these vent holes may also functions as a pair of finger-receiving holes, each having a size enough to insert a finger tip of an user (standard consumers expected from the commercial goods to be contained), such that the pair of folding plates may be pressed by the fingertips to turn into the second position as shown in FIG. 4.

Figure 5:
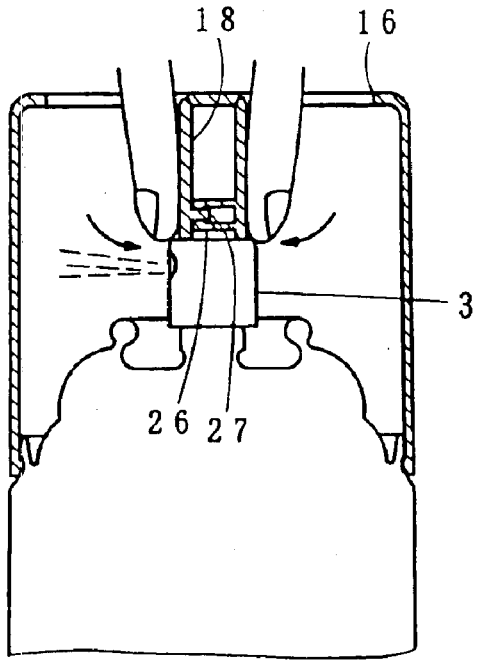
FIG. 5 is an explanation view on the gas-releasing operation showing a state in which the operation is completed.

The partition plate 23 is preferably formed into a generally belt-shape having a pair of parallel opposite sides which is connected through the bendable line 20 to a fixed end 24 of each folding plates 18, 18, such that, when a free end 25 of each side folding place turns to its lowermost position, the folding plates may face each other in parallel as shown in FIG. 5.

The length L of each said folding plates 18, 18 between the fixed end 24 and the free end 25 is long enough to forcibly depress the discharge head 3 to a discharging position, but also short enough to allow the free end 25 to ride over the corner 5 of the discharge head 3, when the the folding plates 18, 18 are turned by the finger inserted into the vent holes 16, 16.

A pair of first and second fitting portions 26,27 are provided on the opposite faces of the folding plates (or lower faces of the same in the first position) for providing a mutual engagement to joint the folding plates in the second position, such that the either of folding plates stops the other folding plate from turning away from the second position.

It is preferable that the first and second fitting portions 26, 27 are allowed to fit each other only when the folding plates 18, 18 are parallel and vertical shown in the drawing. More specifically, it is favorable that the first fitting portion 26 is formed into a fitting cylinder having a length generally equal to the width of the partition plate 23 for keeping the folding plates in parallel, while the second fitting portion 27 is formed into a protrusion which is able to fit firmly into the fitting cylinder for setting the folding plate in vertical postures.

It is also desirable that the bonding strength of the first and second fitting portions 26,27 is sufficient enough to keep the joint between them when the folding plates depress the discharge head. For strengthen the joint, it is also favorable that the first and second fitting portions 26, 27 are provided at the vicinity of the free ends 25 of the folding plates.

The above-mentioned cap is made integrally of synthetic resin.

Figure 6:
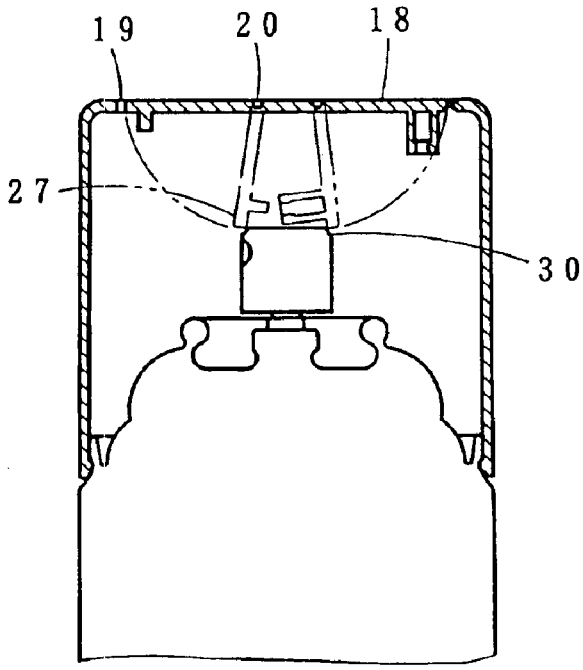
FIG. 6 is a view showing one variation of the cap shown in FIG. 1.
Figure 7:
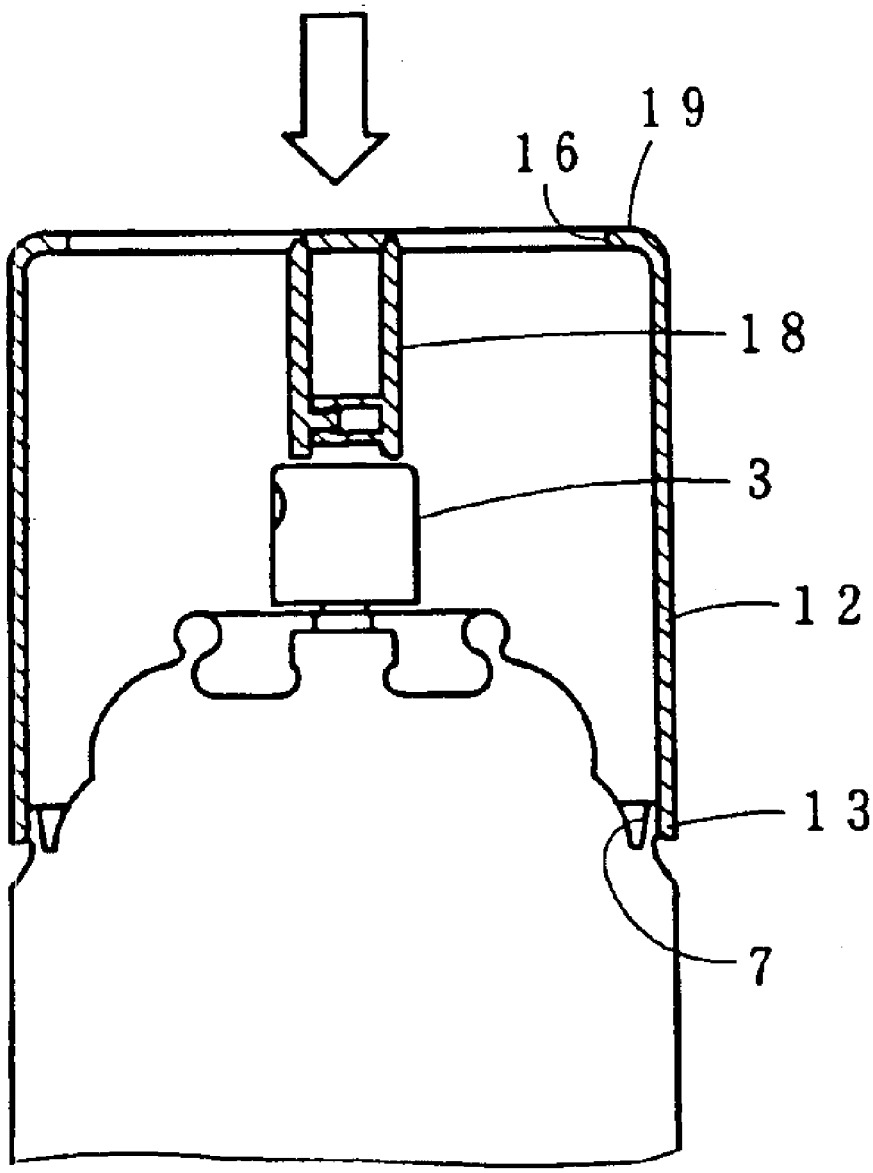
FIG. 7 is a view showing another way of use of the cap shown in FIG. 1.
Figure 8:
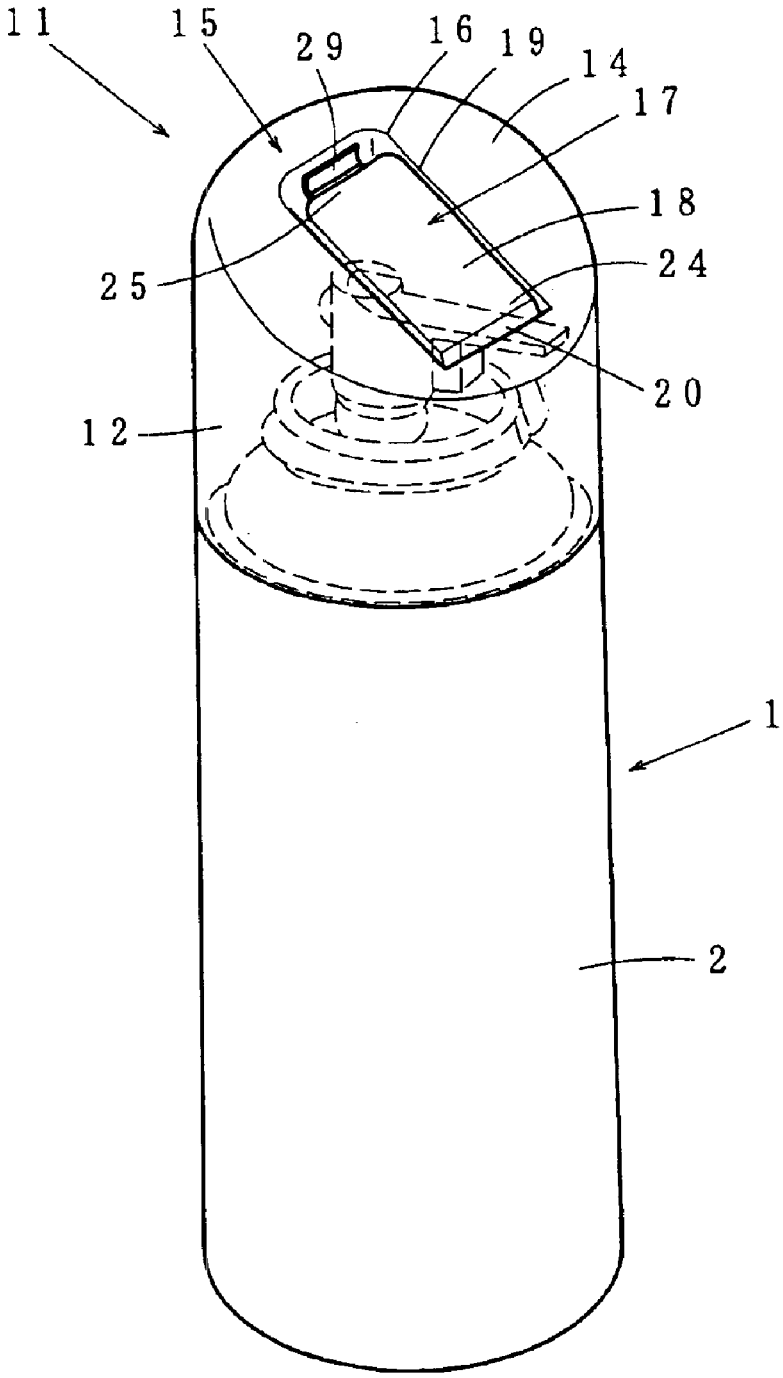
FIG. 8 is a vertical sectional view of a cap according to a second embodiment of the present invention, which is mounted on an aerosol cap.
Figure 9:
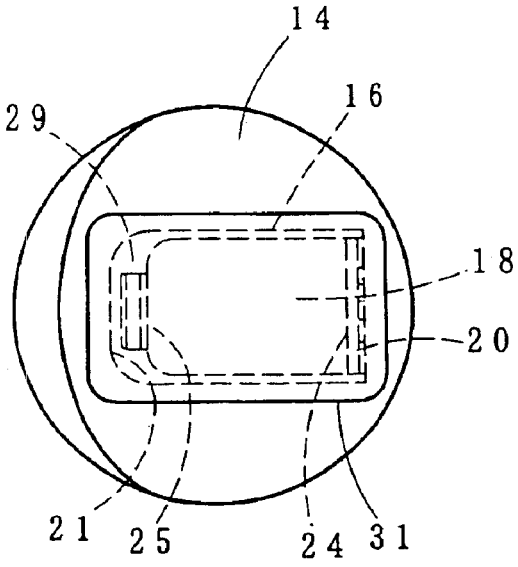
FIG. 9 is a top plan view of the cap shown in FIG. 8.
Figure 10:
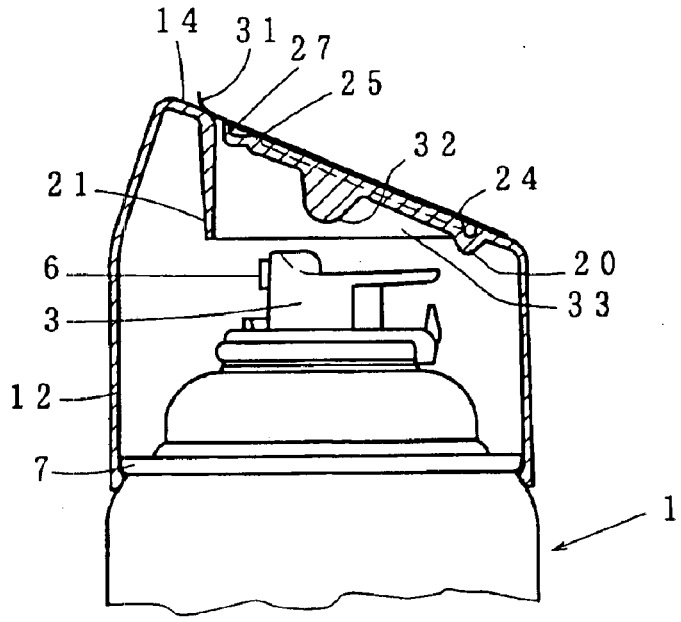
FIG. 10 is a vertical cross section of the cap shown in FIG. 9.
Figure 11:
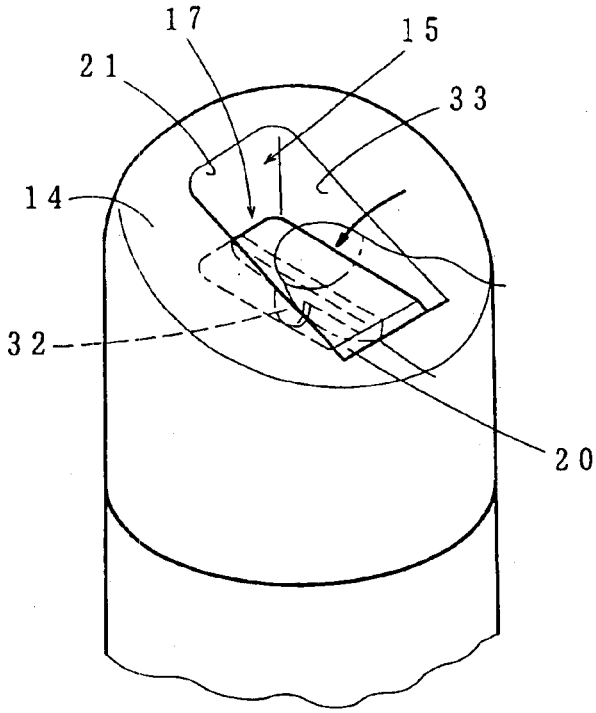
FIG. 11 is an explanation view on gas-releasing operation showing an intermediate state thereof.

FIG. 6 shows a variation of the present invention wherein a chamfer 30 is formed at the corner of the discharge head 3, for reducing the resistance that the free end 25 of the folding plate ride over the corner 5.

Hereinafter, the function of the cap is explained through a description on the usage of the cap. In a state shown in FIG. 1, the user can release the remaining gas by pushing the folding plates 18, 18 downwardly with his/her two fingers such as a thumb and a forefinger, without removing the cap, when the container is used out and to be discarded. Due to the pushing force, the break line 19 is broken, and the folding plates 18, 18 turns on the bendable line 20 from the first position to a state shown in FIG. 3, in which the free end 25 strikes against the corner 5 of the discharge head 3. By nipping the outsides the opposed folding plates by the two fingers, the free end 25 rides over the corner 5 to depress the discharge head 3, and then the first and second fitting portions 26,27 are fitted to keep the depression of the discharge head 3, allowing all the gas to escape outside.

In this way, since it is necessary to release the gas by not only pushing the folding plate 18 into the cap but also nipping the outsides of the opposed folding plates to fit the first and second fitting portions 26,27, it is possible to prevent an unintentional gas-leasing due to accidental contact of the folding plates 18,18 to something else, or miss-operation of the user, i.e. just touching the folding plate unconsciously.

Moreover, these pushing in and nipping of the folding plates 18,18 can be done successively in one action, the gas-operation is very simple.

Upon the gas-releasing operation, on the other hand, it is possible to remove the cap from the container 1 to set the folding plates into the second position and recap it on the container. In this case, the partition plate 23 has a thickness and width sufficient for resisting a shearing stress so as to depress the discharge head 3 by means of the folding plates 18,18 in the second position, when an user, griping the cylinder body member 12, removes the cap from the aerosol container to fit the first and second fitting portions, and fit the cap on the aerosol container.

Figure 12:
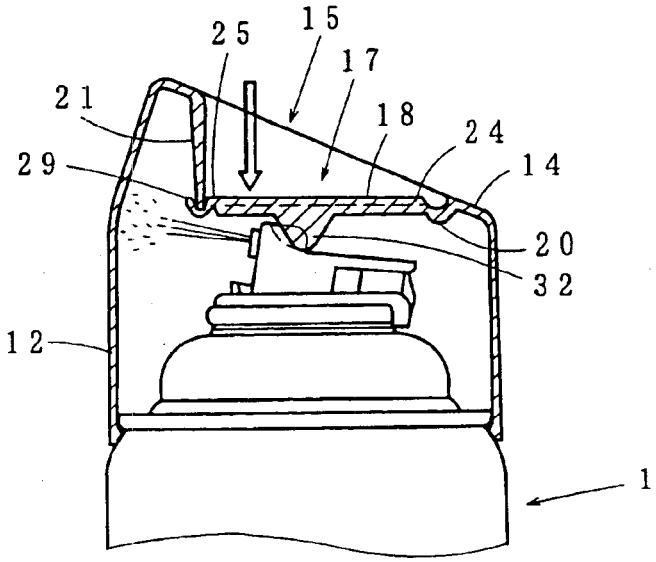
FIG. 12 is an explanation view on gas-releasing operation showing a state in which the operation is completed.

FIGS. 8 to 12 shows a second embodiment of the present invention. The aerosol container 1 used in this embodiment may be the same to the one in the previous embodiment which is actuated by depressing the discharge head vertically, but also be the tilt type container which is actuated by tilting the discharge head with its half portion descending, as shown in FIG. 12. The explanation on the structure generally similar to that in the first embodiment is omitted, by putting the same numeral instead.

The cap according to this embodiment has an aperture 15 which is defined by a single hole located generally above the discharge head 3, and a lid 17 which is formed into a single folding plate 18 for covering the aperture. The folding plate has a fixed end 24 jointed to a margin 28 of the aperture 15 through a bending line 20, and is connected through the break line 19 to the reminder of the margin of the aperture except the bending line. In order to protect the break line in a period of transportation etc, a seal 31 may be attached on the lid 17 and the top plate member 14 thereaound.

The stopper 21 is protruding downwardly from the reminder of the margin for engaging with the folding plate 18 in the second position. An engagement device 13 for providing an engagement with the stopper 21 is provided at a side portion of the folding plate 18 adjoining the stopper 21, such that the stopper 21 and the engagement device 13 may engage each other to keep the folding plate 18 in the second position.

In a preferred shown embodiment, the top plate member 14 is inclined with respect to a central axis of the turbular body member 12 to form a one-slope. This facilitates the user to watch a designation of goods or indication of its contents printed on a protection seal applied on the top plate member 12, when the aerosol containers with the caps are arranged on a show shelf. In this structure, the aperture 15 has a lower marginal portion to which the fixed end 24 of the folding plate 18 is connected through the bendable line 20, and an upper marginal portion from a vicinity of which the stopper 21 is depending. The aperture 15 may be formed into any favorable shape, but, in the shown drawing, it is formed into a rectangle having a margin defined by a pair of upper and lower short side portion and a pair of long side portion.

The stopper 21 is depending from the upper short portion and preferably shaped into a vertical flat plate with its lower end which is generally as high as the lower short side portion. The plate-shaped stopper (or a stopping plate) is disposed parallel to the bendable line 18. On the other hand, a pair of auxiliary plates are depending from the long side portions, each having a side opposite to the bendable line 20 connected to either of the both sides of the plate-shaped stopper.

Meanwhile, the fixed end 24 of the folding plate 18 is connected through the bendable line 20 to the lower short side portion, from which the folding plate 18 is extending obliquely upward to the upper short side portion of the aperture 15 in the first position, such that the upper faces of the folding plate 18 and the top wall member 14 are generally on a single inclined plane. The periphery of the folding plate 18 except the bendable line 20 is connected to the either of the upper short side portion and the long side portions of the aperture by one or more fragile links 19L. After breaking these fragile links by pushing the upper face of the folding plate 18, this plate may turn from the first position in which the folding plate is inclined to close the aperture, to the second position in which the folding plate 18 is generally lateral to depress the discharge head 3 downwardly, with the free end 25 of the folding plate 18 being fixed to the lower end of the plate-like stopper 21 by means of the engagement device 13 thereto. The folding plate 18 has preferably at its lower surface a depressing projection 32 for depressing the top surface of discharge head 3 vertically, such that the stem of the discharge head can descend vertically straight into the container body. Moreover, the depressing projection 32 may have a skid-proof uneven surface like a stain finish form, such that the depressing projection 32 pressed to the discharge head 3 does not slip against the same, such that the discharge head can be depressed more easily and smoothly. The engagement device 13 may preferably be a groove which is formed on the upper face of the folding portion at its leading end, extending parallel to the bendable line 20 to receive the lower end of the stopper 21. It is preferable that the length of the folding plate 18 is long enough that the free end 25 of the folding plate rubs forcibly to the inner face of the plate shaped stopper 21 when the folding plate turns from the first position to the second position such that the folding plate clicks the groove to fix it to the lower end of the plate-shaped stopper 21.

In the aforementioned construction, the gas remaining in the container is released by pressing the folding plate 18 into the cap, such that the folding plate turns on the bendable line 20. The free end 25 of the folding plate 18 having the groove-shaped engagement device 13 is descending while rubbing against the inside of the plate-like stopper 21 forcibly, and then clicked to engage with the lower end of the stopper 21. Due to the click movement, it is apparent for the user that the free end 25 is locked to the stopper, such that the gas can be released with certainly. Moreover, the folding plate 18 may be turned by pushing it down by one finger, the gas-releasing action is facilitated. Furthermore, when the folding plate 18 is turning, the free end 25 is pressed against and contact with the inside of the plate-shaped stopper, such that there is no gap between the stopper and folding plate. As the result, there is no inconvenience that the finger of the user is inserted into such a gap and nipped by the stopper and the folding plate.

When the folding plate 18 is turned to the second position, the depressing projection 32 depresses the discharge head 3 having the nozzle from which the gas is discharged into the cap, and then released to the outside gradually, through the opening defined between the margin of the aperture 15 and the periphery of the folding plate 18 except the bendable line 20. Due to this structure, or more specifically due to the construction that the nozzle faces against the inside of the turbular body portion 12 encircling the discharge head 3, the ejected gas is prevented from discharging directly against the user to suck the same, or scatters rapidly to soil the person nearby.

Meanwhile, if the user wishes to exhaust the pressurized gas except the content, it is possible only by putting the cap on the aerosol container in a discharging state, and inverting it, such that the only pressurized gas is exhausted completely.

FIGS. 13 to 16 shows a third embodiment of the present invention. The embodiment is different from the first embodiment in that the top plate member 14 has an aperture 15 defined by a single hole, and in that the lid 17 has a folding plate 18 for closing the aperture in the first position and a depression plate 41 for depressing the discharge head 3 in the second position, and in that the stopper 21 for engaging with the depression plate. Explanation on the structure similar to that of the first embodiment is omitted by putting numeral instead.

Figure 13:
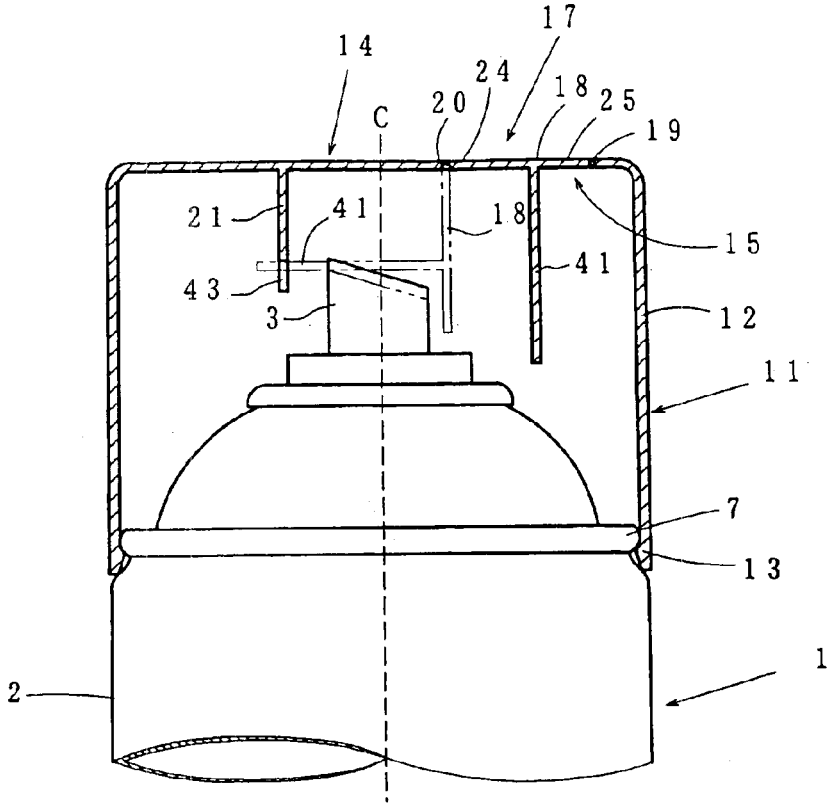
FIG. 13 is a vertical sectional view of a cap according to a third embodiment of the present invention, which is mounted on an aerosol cap.
Figure 14:
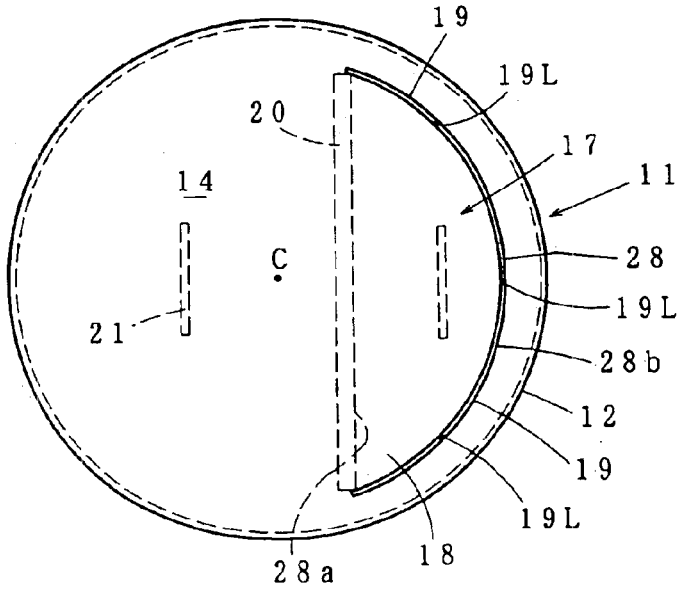
FIG. 14 is a top plan view of the cap shown in FIG. 13.
Figure 15:
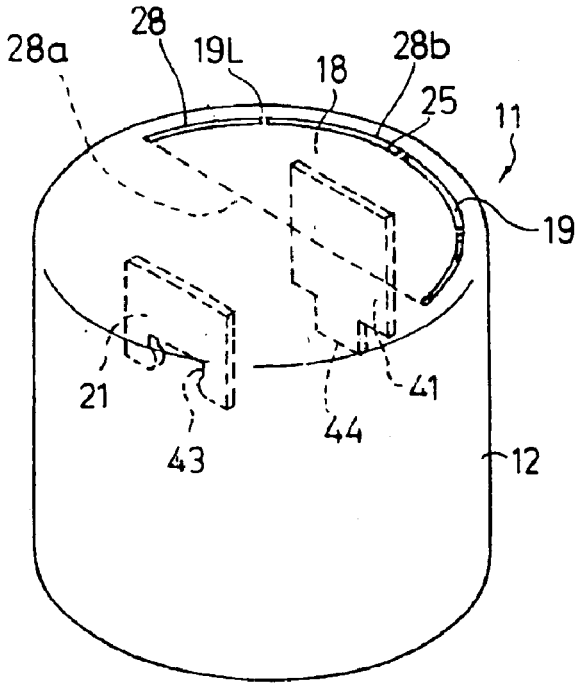
FIG. 15 is a perspective view of the cap shown in FIG. 13.
Figure 16:
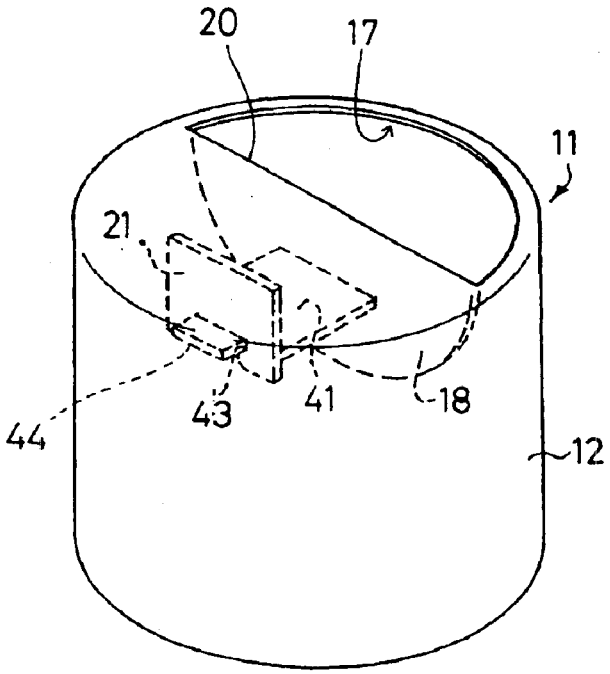
FIG. 16 is an explanation view on gas-releasing operation showing a state in which the operation is completed.

The aperture 15 is located eccentrically, deviating from a longitudinal central axis (c) of the discharge head 3 as shown in FIG. 13 and FIG. 14. In a preferred shown embodiment, the aperture has a generally bow-shaped margin 28 which consists of an inner marginal portion 28*a* which is close to the of the center axis (c) and preferably made straight, and an outer marginal portion 28*b* which is preferably shaped into an arc keeping a same distance from a circular periphery of the top plate member 12.

The folding plate 18 has a shape corresponding to that of the aperture 15, and is connected to the inner marginal portion 28*a* through the bendable line 20 and to the outer marginal portion 28*b* through the break line 19 in the first position. And also, the folding plate 18 is formed integrally with the depression plate 41 depending from a lower surface of the folding plate 18 in the first position, such that the depression plate 41 is located above the discharge head 3 as depicted by a double dot lines in FIG. 13, when the folding plate 18 is turned on the bendable line 20 from the first position to the second position.

The stopper (or a stopping plate) 21 is depending from one side of the top plate member 14 generally opposite to the bendable line 20, for engaging with a leading end portion 42 of the depression plate 41 in the second position. Or alternatively, the folding plate 18 may be formed in one of half plate parts of the top plate member 14, while the stopper 21 is formed in the other of half plate parts of the same. In a shown embodiment, the leading end portion 42 of the stopping plate 21 has a notch 43, while the lower end of the depression plate is formed into a reduced width portion 44 for fitting into the notch.

In the above-mentioned construction, it is possible to automatically release the gas remaining in the container by the fitting the cap body thereto with its folding plate bending into the cap, while unintentional gas releasing is prevented by the miss-operation, i.e., fitting the cap to the aerosol container before it is used out, unless the folding plate is bent into the cap. Moreover, it is easy to make the cap into the state of use only by depressing the folding plate, since the folding plate is provided as a part of the top plate member 14.

FIGS. 17 to 20 shows the fourth embodiment of the present invention. According to this embodiment, the folding plate 18 for depressing the discharge head 3 may be at any portion of the cap body 11, particularly favorably in a turbular body member 12. Explanation on the construction same to that of the first embodiment will be omitted, by putting the same numeral instead.

Figure 17:
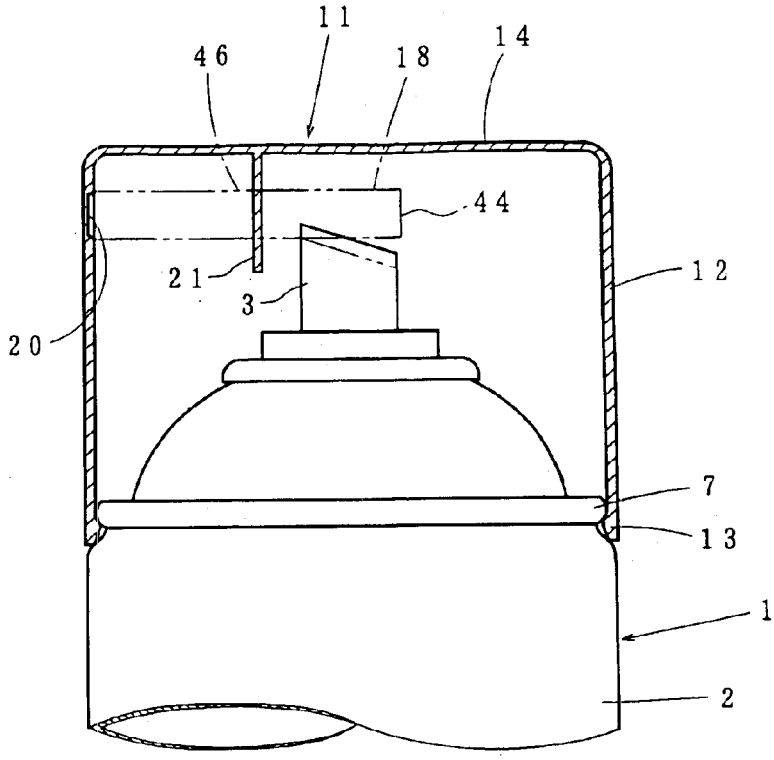
FIG. 17 is a vertical sectional view of a cap according to a fourth embodiment of the present invention, which is mounted on an aerosol cap.
Figure 18:
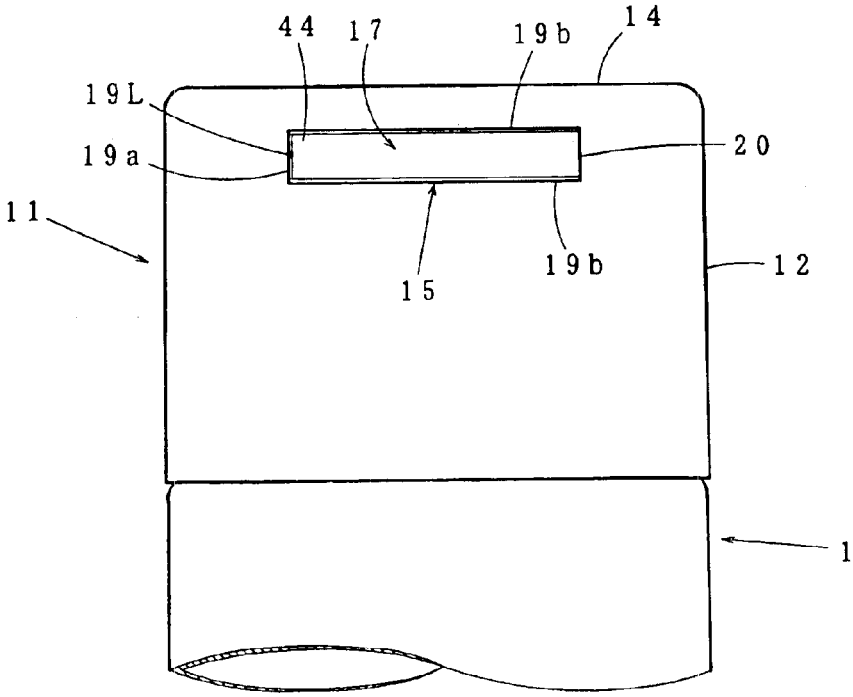
FIG. 18 is a top plan view of the cap shown in FIG. 17.
Figure 19:
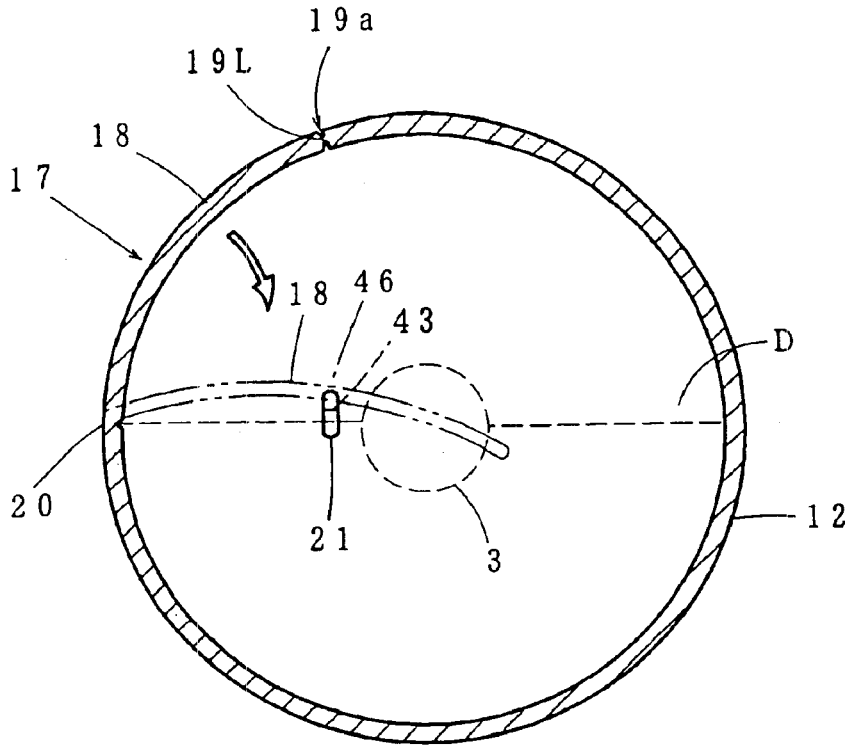
FIG. 19 is a lateral section of the cap shown in FIG. 17 explaining how to use it.
Figure 20:
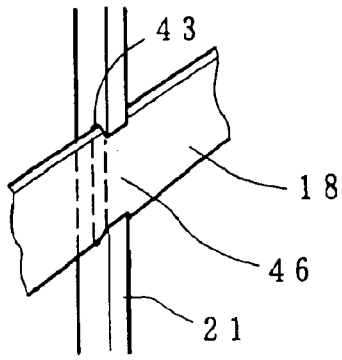
FIG. 20 is an enlarged view of an element of the cap shown in FIG. 17.

The folding plate 18 may favorably be made by a lateral belt-shaped portion of the turbular body member 12 which is defined as shown in FIG. 18 by a longitudinal break line 19*a*, a longitudinal bendable line 20, a lateral (or circumferential) upper break line 19*b* for connecting respective upper ends of the longitudinal break line 19*a* and the longitudinal bendable line 20, a lateral (or circumferential) lower break line 19*b* for connecting respective lower ends of the longitudinal break line 19*a* and the longitudinal bendable line 20. Due to this construction, the folding plate 18 may has a leading end portion 42 defined in a vicinity of the longitudinal break line 19*a,* after the lateral and longitudinal break lines 19*b,* 19*a* are broken. By breaking the break lines, the folding plate 18 is able to turn on the bendable line 20 from a fist position in which the folding plate 18 is on a profile of the turbular body member 12 to a second position in which the folding plate 18 orients inwardly from the bendable line 20, protruding the leading end portion 42 into the cap, as shown in FIG. 19. The aperture 15 for gas-releasing is formed between the two lateral break lines 19*b,* 19*b* after the folding plate 18 is turned to the second position. The leading end portion 42 of the folding plate gets in contact with a top face of the discharge head 3, when the discharge head is depressed as shown in FIG. 17.

The stopping plate 21 is depending from the top plate member 18 to engage with a portion of the folding plate 18 for maintain a contact between the folding plate and the discharge head 3. The stopping plate 21 may preferably have a notch 43 for engaging with a portion of the folding plate 14. It is preferable that the stopping plate 21 is formed generally on a diameter D of the turbular body member 12 shown in FIG. 19 extending from a bendable line 18 to the center of the turbular body member 12, and more preferably the stopping plate 21 may be formed between the bendable portion between the bendable portion 20 and the discharge head 3 generally. In this case, an intermediate portion 46 of the folding plate 18 may be formed into a reduced-width portion (not shown) having a vertical width smaller than the other part of the folding plate for facilitating engagement with the notch 43.

Figure 21:
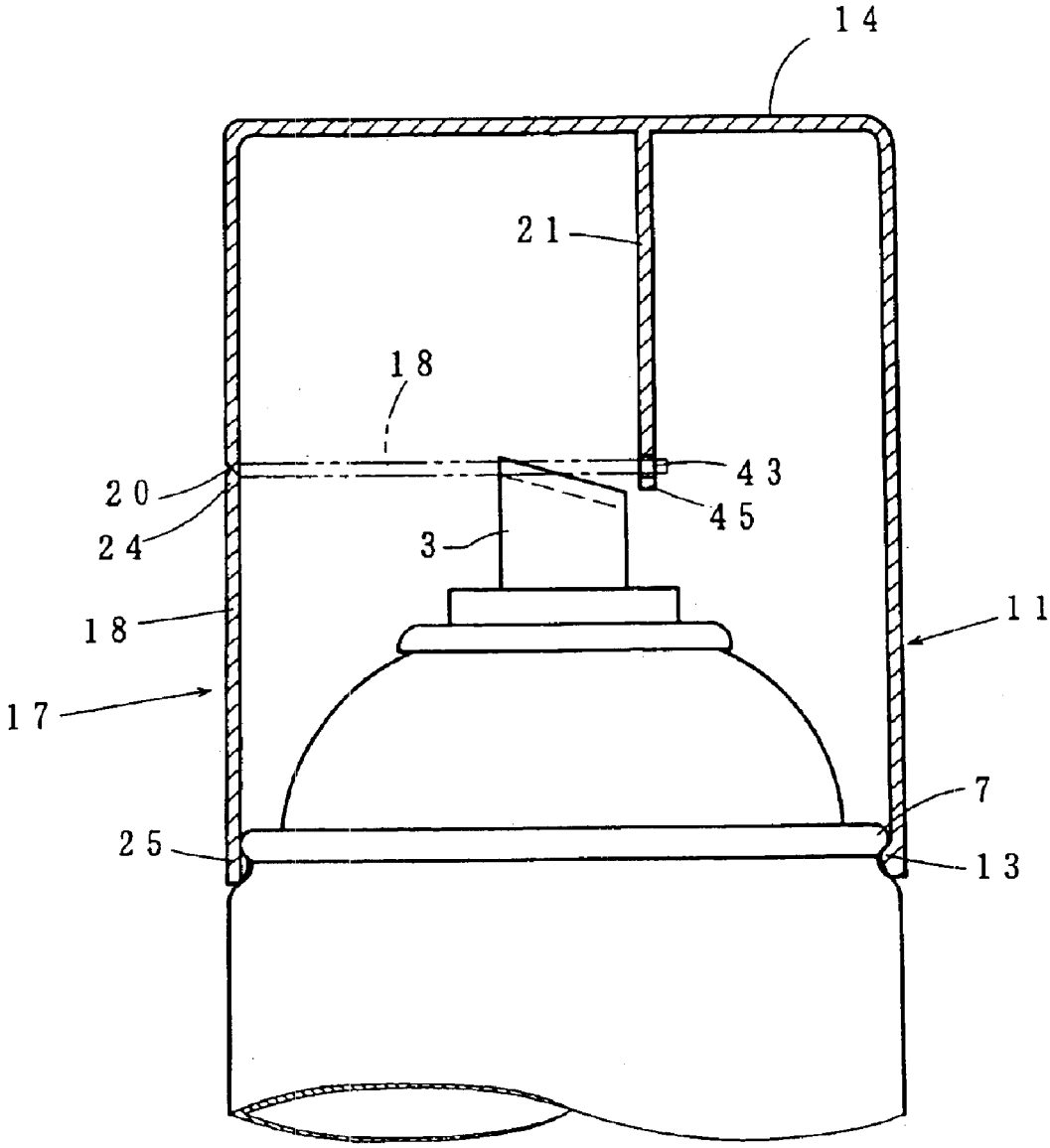
FIG. 21 is a vertical sectional view of a cap according to a fifth embodiment of the present invention, which is mounted on an aerosol cap.
Figure 22:
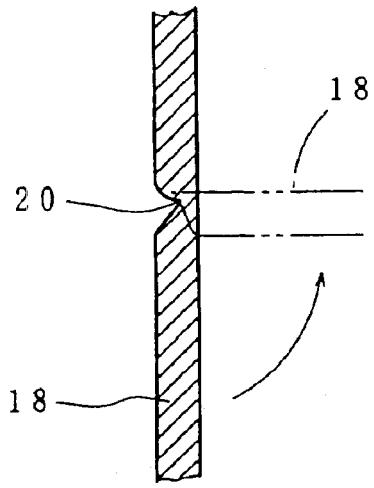
FIG. 22 is an enlarged view of an element of the cap shown in FIG. 21.
Figure 23:
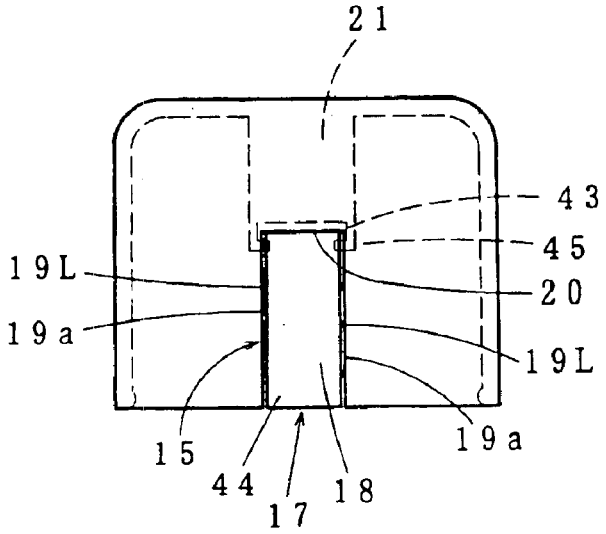
FIG. 23 is a front view of the cap shown in FIG. 21
Figure 24:
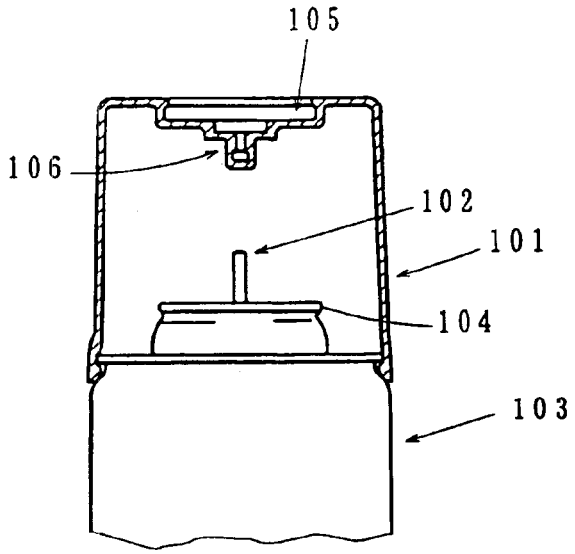
FIG. 24 is a vertical sectional view of a conventional cap prior to the present invention.
Figure 25:
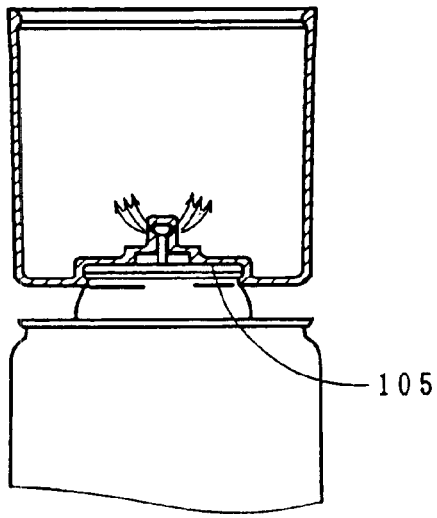
PRIOR ART FIG. 25
FIG. 25 is an explanation view of a gas releasing operation of the cap shown in FIG. 24.
Figure 26:
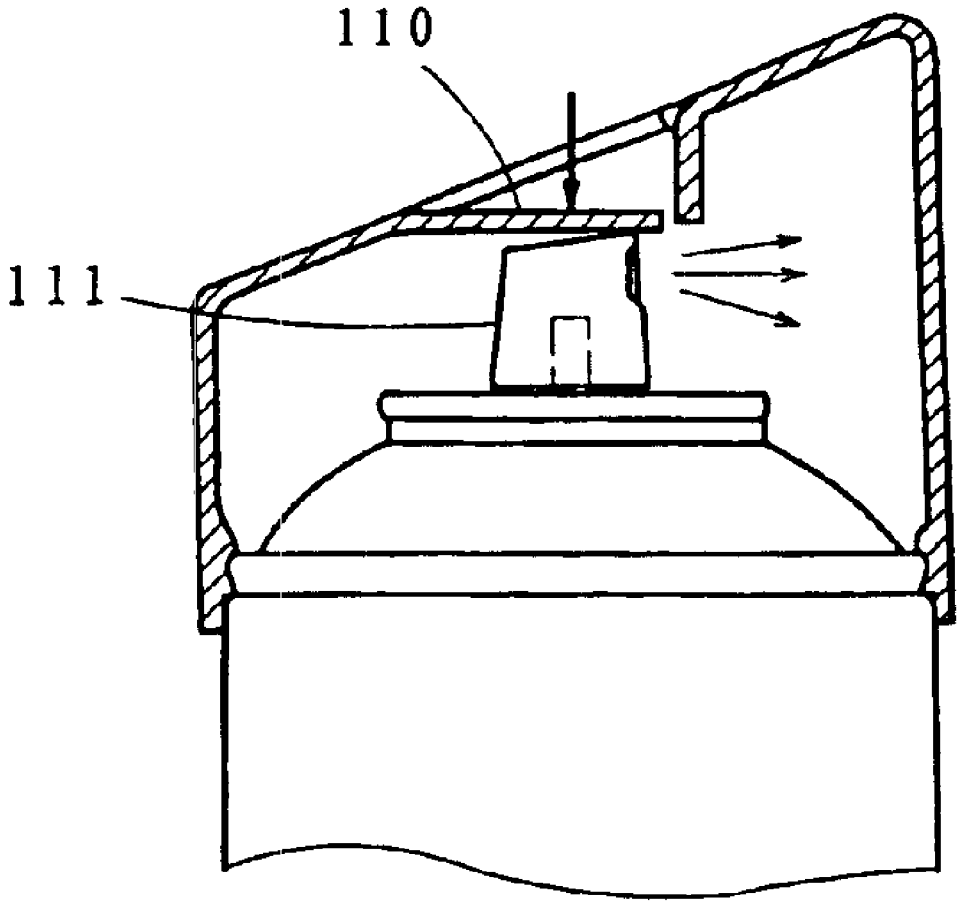
FIG. 26 is a vertical sectional view of another conventional cap prior to the present invention.

FIGS. 21 to 23 shows the fifth embodiment of the present invention. This embodiment differs from the fourth embodiment in the configuration of the folding plate 18 mainly. Accordingly, explanation on the construction similar to that of the fourth embodiment is omitted by putting the same numeral instead.

As shown in FIG. 23 the folding plate 18 is formed by a generally longitudinal belt-shaped portion of the turbular body member 12 which is defined by a lateral bendable line 20 and a pair of longitudinal break lines 19*a,* 19*a* extending downwardly from a pair of said bendable line 20, 20 to a lower end of the turbular body member. In this construction, the folding plate 18 has a leading end portion 42 which is defined by a part of the lower end of the turbular body member between the pair of longitudinal break lines, and corresponds to the aforementioned free end. And also, the folding plate 18 is able to turn on the bendable line 20 from a first position in which the folding plate 18 is depending vertically on a profile of the turbular body member 12 to a second position in which the folding plate 18 orients horizontally and inwardly of the cap, protruding the leading end portion 42 into the same, as depicted by a double-dot chain line shown in FIG. 21. The leading end portion 42 of the folding plate 18 is also adapted to contact with a top face of the discharge head 3, when the discharge head 3 is depressed, for maintaining such a depressed condition.

Moreover, in that the stopping plate 21 is depending from the top plate member 14 to engage with a portion of the folding plate 18 for maintaining a contact between the folding plate and the discharge head 3. The stopping plate 21 may preferably be provided at its lower end with a notch 43 for engaging with the folding plate 18 as depicted by a broken line in FIG. 23. In a preferred shown embodiment, the notch 43 may be formed between a pair of hooks 45,45 for catching two sides of the folding plate 18, while the pair of hooks are provided at the two sides of the stopping plate 21. Moreover, the leading end of the folding plate 18 may be formed into a wide-reduced portion (not shown), which is shaped for example as shown in the third embodiment for facilitating an engagement with the notch 43.

What is claimed is:

1. A cap for mounting on an aerosol container having a container body with a top end from which a discharge head is protruding upwardly, said cap comprising:

a tubular body member having a lower part which is able to be engaged to an upper part of said container body, a top plate member having a periphery connected to an upper end portion of the tubular body member so as to close a top surface of the tubular body member, said top plate member having an aperture and a lid for closing the aperture, said lid having a fixed end which is connected to a margin of the aperture through a bendable line, such that the lid is able to turn from a first position in which the lid closes the aperture, to a second position in which the lid is protruding into the tubular body member so as to get in touch with a top face of the discharge head that is pressed generally downwardly, said top plate member also having a stopper for fixing the lid in the second position so as to keep the discharge head in such a pressed state, wherein the aperture is located generally above the discharge head when the cap is mounted on the container; and the lid is formed into a folding plate having the fixed end joined to the margin of the aperture through the bendable line, and being connected to a remainder of the margin of the aperture except the bendable line through a break line for keeping the folding plate in the first position; and in that the stopper is protruding downwardly from the remainder of the margin for engaging with the folding plate in the second position while an engagement device for engaging with the stopper is provided at a side portion of the folding plate adjoining the stopper, such that the stopper and the engagement device may engage each other to keep the folding plate in the second position.

2. A cap for mounting on an aerosol container according to claim 1, wherein the top plate member is inclined to form a one way slope such that the aperture has a lower marginal portion to which the fixed end of the folding plate is connected through the bendable line, and an upper marginal portion from a vicinity of which the stopper is depending, and in that the engagement device is provided at a free end of the folding plate opposite from the fixed end for receiving a lower end of the stopper.

* * * * *